US012571595B2

(12) United States Patent
Araki et al.

(10) Patent No.: US 12,571,595 B2
(45) Date of Patent: Mar. 10, 2026

(54) PLATE WITH FLOW CHANNEL

(71) Applicant: NHK Spring Co., Ltd., Yokohama (JP)

(72) Inventors: Yoshihito Araki, Kanagawa (JP); Shuhei Morota, Kanagawa (JP); Toshihiko Hanamachi, Kanagawa (JP); Hibiki Yokoyama, Kanagawa (JP)

(73) Assignee: NHK Spring Co., Ltd., Yokohama (JP)

( * ) Notice: Subject to any disclaimer, the term of this patent is extended or adjusted under 35 U.S.C. 154(b) by 0 days.

(21) Appl. No.: 17/312,110

(22) PCT Filed: Dec. 3, 2019

(86) PCT No.: PCT/JP2019/047274
§ 371 (c)(1),
(2) Date: Jun. 9, 2021

(87) PCT Pub. No.: WO2020/121898
PCT Pub. Date: Jun. 18, 2020

(65) Prior Publication Data

US 2022/0026151 A1 Jan. 27, 2022

(30) Foreign Application Priority Data

Dec. 14, 2018 (JP) ..... 2018-234929
Oct. 4, 2019 (JP) ..... 2019-184146

(51) Int. Cl.
*F28F 9/02* (2006.01)
*F28D 1/02* (2006.01)
(Continued)

(52) U.S. Cl.
CPC ..... *F28D 1/0246* (2013.01); *F28D 1/0233* (2013.01); *F28D 1/05358* (2013.01);
(Continued)

(58) Field of Classification Search
CPC .. F28D 1/0264; F28D 1/0288; F28D 1/05358; F28F 1/025; F28F 1/04; F28F 9/0282
See application file for complete search history.

(56) References Cited

U.S. PATENT DOCUMENTS 6,471,779 B1 10/2002 Nishio et al.
6,490,145 B1 12/2002 Kholodenko et al.
(Continued)

FOREIGN PATENT DOCUMENTS

CN 101533798 A 9/2009
CN 102216791 A 10/2011
(Continued)

OTHER PUBLICATIONS

Supplementary European Search Report dated Jul. 21, 2022, issued for European Patent Application No. 19897308.3.
(Continued)

*Primary Examiner* — Devon Lane
(74) *Attorney, Agent, or Firm* — Troutman Pepper Locke LLP

(57) ABSTRACT

A plate includes: a main body; a flow channel provided in the main body and configured to flow inert gas therein; a cover configured to cover a surface of the main body where the flow channel is formed; a buried member buried in an opening of the flow channel, the buried member including a buried portion fixed to the flow channel and made of dense ceramic, and a flow portion held by the buried portion and configured to let the inert gas flow from an inside to an outside of the main body, at least a part of the flow portion being made of porous ceramic; and a plurality of through holes provided in the flow portion. A ratio of a diameter of an outer circumference of the buried portion to a diameter of a smallest circle among circles including all of the through holes is 1.2 or higher.

7 Claims, 7 Drawing Sheets

(51) Int. Cl.

| | |
|---|---|
| ***F28D 1/053*** | (2006.01) |
| ***F28F 1/02*** | (2006.01) |
| ***F28F 1/04*** | (2006.01) |

(52) U.S. Cl.

CPC ..... *F28F 1/025* (2013.01); *F28F 1/04* (2013.01); *F28F 9/0282* (2013.01)

(56) References Cited

U.S. PATENT DOCUMENTS

| | | | |
|---|---|---|---|
| 2002/0135969 | A1 | 9/2002 | Weldon et al. |
| 2004/0190215 | A1* | 9/2004 | Weldon ..... C23C 16/4586 361/234 |
| 2009/0218517 | A1 | 9/2009 | Bedingham et al. |
| 2009/0229753 | A1 | 9/2009 | Ohmi et al. |
| 2009/0230636 | A1 | 9/2009 | Goto |
| 2011/0227596 | A1 | 9/2011 | Kazama et al. |
| 2016/0276198 | A1 | 9/2016 | Anada et al. |

FOREIGN PATENT DOCUMENTS

| | | | | |
|---|---|---|---|---|
| CN | 108649012 | A | | 10/2018 |
| JP | H05-77257 | U | | 10/1993 |
| JP | 2000-315680 | A | | 11/2000 |
| JP | 2003-338492 | A | | 11/2003 |
| JP | 2006344766 | A | * | 12/2006 |
| JP | 2008-307895 | A | | 12/2008 |
| JP | 2009-218517 | A | | 9/2009 |
| JP | 3154629 | U | | 10/2009 |
| JP | 2010-123712 | A | | 6/2010 |
| JP | 2014-209615 | A | | 11/2014 |
| JP | 2016-143743 | A | | 8/2016 |
| JP | 2016143744 | A | * | 8/2016 |
| JP | 2017-135351 | A | | 8/2017 |
| TW | 201438141 | A | | 10/2014 |

OTHER PUBLICATIONS

Office Action dated Jun. 4, 2020, issued for Taiwanese Patent Application No. 10920531590 and English translation thereof.

Decision to Grant and Search Report dated Mar. 1, 2024, issued for the Chinese Patent Application No. 201980081476.3 and English translation thereof.

Li Wen-fang et al., "The application of beryllia ceramics," Light Metals, Feb. 2010, pp. 20-23 and English abstract. (cited in the Mar. 1, 2024 Decision to Grant issued for CN201980081476.3).

Office Action dated Apr. 28, 2023, issued for In the corresponding Chinese patent application No. 201980081476.3 and English translation thereof.

* cited by examiner

PLATE WITH FLOW CHANNEL

FIELD

The present invention relates, for example, to a plate that discharges cooling gas and includes a flow channel.

BACKGROUND

Conventionally, it has been known that a heat exchanging plate having a cooling function is used as a plate to hold a work in a semiconductor manufacturing device that manufactures a semiconductor used for industrial use, an automobile, or the like, and a liquid crystal manufacturing device that manufactures a liquid crystal display. The heat exchanging plate is made of metal or a ceramic composite, and has a flow channel through which a heating or cooling medium moves, and a hole portion through which inert gas is discharged from the heat exchanging plate to the outside (see, for example, Patent Literature 1). In Patent Literature 1, a porous body is provided in the hole portion, and the inert gas is discharged to the outside through this porous body.

CITATION LIST

Patent Literature

Patent Literature 1: JP 2014-209615 A

SUMMARY

Technical Problem

FIG. 8 is a cross-sectional view illustrating a configuration of a main part of a conventional heat exchanging plate, and is a cross-sectional view for describing arcing that is generated in the vicinity of a position where a porous body is arranged. The conventional heat exchanging plate includes a main body portion 100 in which a hole portion 110 through which inert gas flows is formed. A holding portion 120 that holds a porous body 120A is provided in the hole portion 110. The holding portion 120 and the porous body 120A are formed of a ceramic. Moreover, the holding portion 120 is fixed to the main body portion 100 by thermal spraying. An outer peripheral portion of the porous body 120A, and the main body portion 100 and the holding portion 120 are covered with a sprayed film 130.

For example, when etching is performed, while a temperature adjustment is performed by the heat exchanging plate described above, there is a case where the holding portion 120 or the porous body 120A is destroyed by an arcing phenomenon. Specifically, overvoltage enters through a path Y1 that reaches the main body portion 100 via the sprayed film 130 or a path Y2 that reaches the main body portion 100 via the porous body 120A, and the holding portion 120 or the porous body 120A is destroyed.

The present invention is made in view of the above, and an object thereof is to provide a plate with a flow channel which plate can suppress generation of an arcing phenomenon.

Solution to Problem

To solve the above-described problem and achieve the object, a plate with a flow channel according to the present invention includes: a main body portion in which the flow channel to let inert gas flow is formed; and a cover configured to cover a surface of the main body portion where the flow channel is formed, wherein a buried member buried in an opening of the flow channel is provided in the flow channel of the main body portion, the buried member includes a buried portion fixed to the flow channel, and a flow portion held by the buried portion and configured to let the inert gas flow from an inside to an outside of the main body portion, a plurality of through holes is provided in the flow portion, and a ratio of a diameter of an outer circumference of the buried portion to a diameter of a smallest circle among circles including all of the through holes is 1.2 or higher.

Moreover, in the above-described plate with a flow channel according to the present invention, the buried member is fixed to the main body portion by an insulating adhesive.

Moreover, in the above-described plate with a flow channel according to the present invention, the buried portion has a shape in which a diameter of an outer shape is decreased from a side exposed to the outside toward an opposite side.

Moreover, in the above-described plate with a flow channel according to the present invention, the opening of the flow channel has a stepped hole shape, and the outer shape of the buried portion has a protruded shape corresponding to the shape of the opening.

Moreover, in the above-described plate with a flow channel according to the present invention, the flow portion is made of porous ceramics.

Moreover, in the above-described plate with a flow channel according to the present invention, the buried member has an insulating property.

Moreover, in the above-described plate with a flow channel according to the present invention, a second through hole configured to make the flow portion and the flow channel communicate with each other is formed in the buried portion, and a formed region of the second through hole and a formed region of the plurality of through holes in the flow portion are arranged at different positions when viewed in a penetrating direction.

Moreover, in the above-described plate with a flow channel according to the present invention, the cover is configured to cover a part of the buried portion.

Advantageous Effects of Invention

According to the present invention, it is possible to suppress generation of an arcing phenomenon.

DESCRIPTION OF EMBODIMENTS

In the following, an embodiment of the present invention will be described in detail together with the drawings. Note that the present invention is not limited to the following embodiment. Moreover, each of the drawings referred to in the following description merely illustrates a shape, size, and positional relationship schematically to such an extent that contents of the present invention can be understood. That is, the present invention is not limited to the shape, size, and positional relationship exemplified in each drawing.

EMBODIMENT

Figure 1:
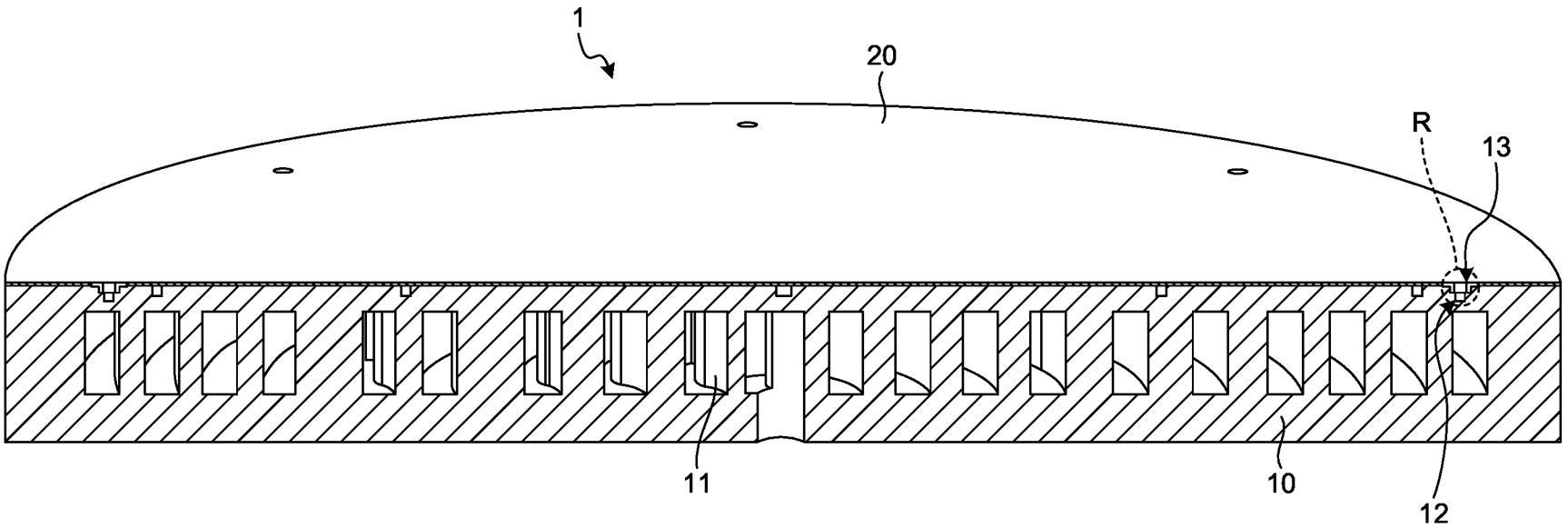
FIG. 1 is a cross-sectional view illustrating a structure of a heat exchanging plate according to one embodiment of the present invention.
Figure 2:
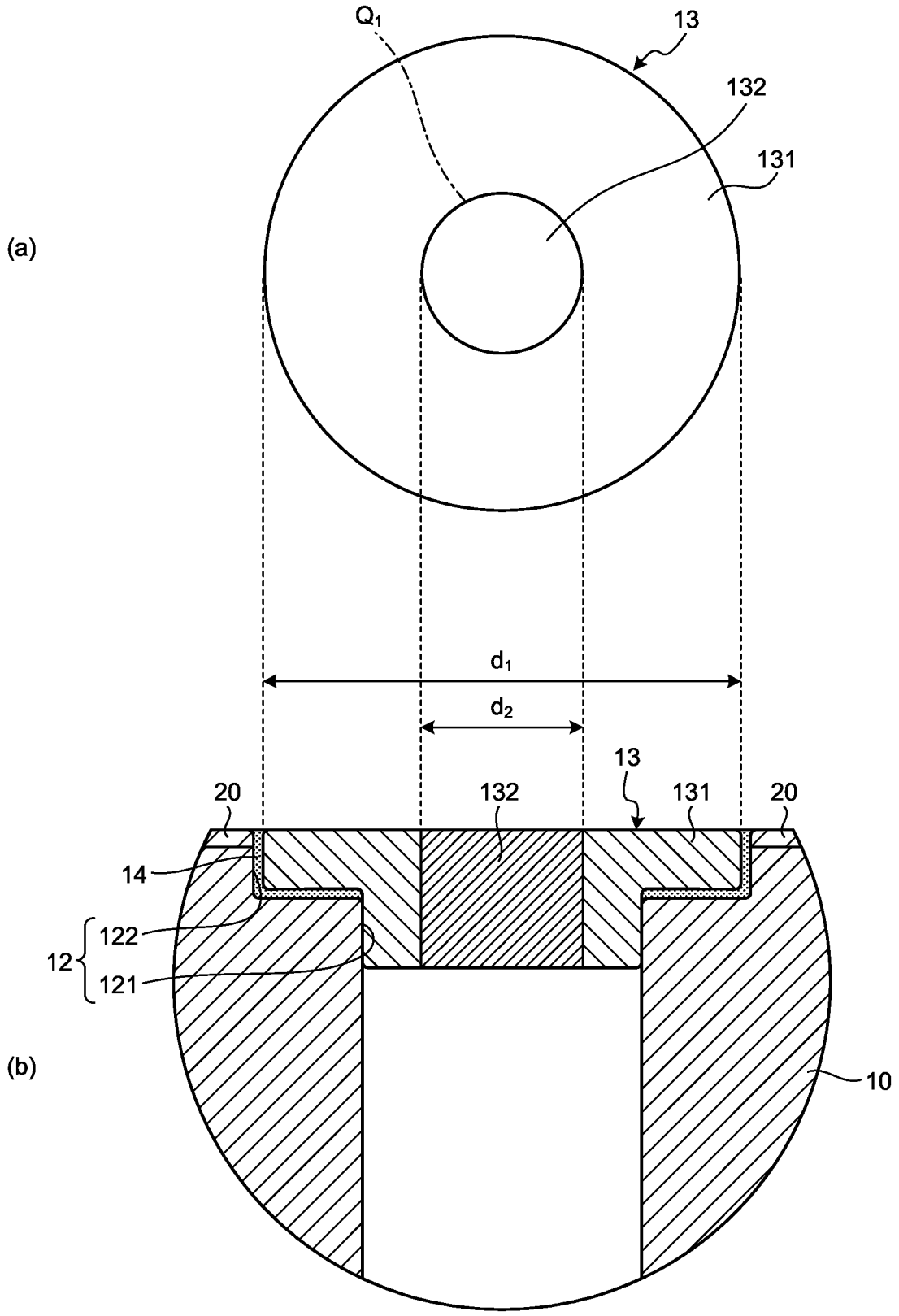
FIG. 2 is a schematic diagram for describing a configuration of a main part of the heat exchanging plate according to the one embodiment of the present invention.

FIG. 1 is a partial cross-sectional view illustrating a structure of a heat exchanging plate according to one embodiment of the present invention. FIG. 2 is a schematic diagram for describing a configuration of a main part of the heat exchanging plate according to the one embodiment of the present invention. (a) of FIG. 2 is a plan view illustrating a buried member 13 in the heat exchanging plate. (b) of FIG. 2 is a cross-sectional view in which a region R illustrated in FIG. 1 is enlarged. A heat exchanging plate 1 illustrated in FIG. 1 includes a disk-shaped main body portion 10, and a cover 20 that covers one surface (here, upper surface) of the main body portion 10. The heat exchanging plate 1 is a plate with a flow channel in which plate a flow channel to let inert gas flow is formed.

The main body portion 10 has a disk shape made of aluminum, an aluminum alloy, titanium, a titanium alloy, stainless steel, a nickel alloy, or the like. In the main body portion 10, a flow channel 11 through which a medium to promote a heat exchange flows, and a flow channel 12 through which inert gas to promote a heat exchange with a target member flows and which performs a discharge thereof to the outside are formed. The medium is, for example, liquid such as water, or gas.

The cover 20 is a sprayed film that covers the upper surface of the main body portion 10 by thermal spraying, and is provided on an opening-formed surface of the flow channel 12.

In the heat exchanging plate 1, the medium is introduced from a medium inflow port (not illustrated), is made to flow through the flow channel 11, and is discharged from a medium discharge port (not illustrated). In the heat exchanging plate 1, heat transferred from a heat source is discharged to the outside through the main body portion 10 and the cover 20, or a medium that absorbs the heat transferred from the heat source is discharged from the flow channel.

Moreover, in the heat exchanging plate 1, inert gas is introduced from an inert gas introduction port (not illustrated), and the inert gas flows through the flow channel 12 and is discharged to the outside. The inert gas comes into contact with a target member and cools the member.

The flow channel 12 has a flow channel portion 121 one end of which is connected to the inert gas introduction port and which forms a flow channel in the main body portion 10, and an opening portion 122 provided at the other end of the flow channel portion 121. A diameter of the opening portion 122 is larger than a diameter of the other end of the flow channel portion 121. Thus, the flow channel 12 has a stepped hole shape in the vicinity of the opening.

A buried member 13 buried in the opening of the flow channel 12 is provided in the flow channel 12. The buried member 13 has a buried portion 131 buried in the flow channel 12, and a flow portion 132 held by the buried portion 131.

The buried portion 131 is made of a ceramic and is formed by utilization of a dense body having porosity equal to or lower than 20%. The porosity of the buried portion 131 is preferably 15% or lower. The buried portion 131 has a protruded outer shape and is housed in the opening portion 122. As the ceramic, an insulating ceramic is used.

The flow portion 132 is porous ceramics, and lets a medium such as gas flow from one side to the other side (in vertical direction in FIG. 2). A plurality of through holes that penetrates the one side and the other side and lets the medium flow is formed in the porous ceramics included in the flow portion 132

An adhesive 14 is provided between the buried portion 131 and the opening portion 122, and the two are fixed by the adhesive 14. The adhesive 14 is made of an insulating material.

Here, when a diameter of an outer circumference (outside diameter) of the buried portion 131 is $d_1$ and a diameter of an outer circumference (outside diameter) of the flow portion 132 is $d_2$, a ratio of the outside diameter $d_1$ to the outside diameter $d_2$ ($d_1/d_2$) is 1.2 or higher, and is preferably 1.5 or higher. In the present embodiment, it is possible to adjust the outside diameter of the flow portion 132, that is, a discharge amount of the inert gas within a range of the above ratio. Here, a circle formed by the outer circumference of the flow portion 132 (circle $Q_1$ illustrated in FIG. 2) corresponds to the smallest circle among circles formed in the flow portion 132 and including all the through holes.

Figure 8:
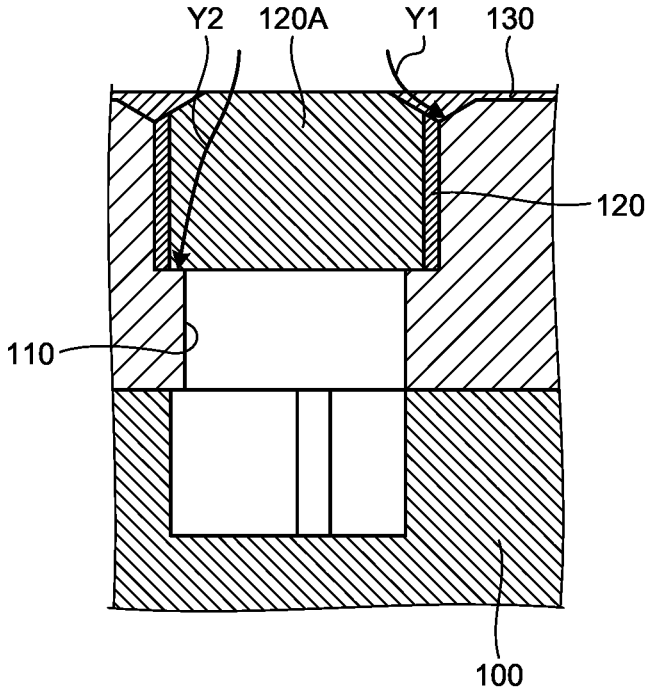
FIG. 8 is a cross-sectional view illustrating a configuration of a main part of a conventional heat exchanging plate, and is a cross-sectional view for describing arcing generated in the vicinity of a position where a porous body is arranged.

Moreover, since being a distance along the stepped portion formed by the opening portion 122 and the flow channel portion 121, a creepage distance of the buried member 13 in the flow channel 12 is a distance longer than a conventional one (see, for example, FIG. 8).

As described above, in the heat exchanging plate 1 according to the present embodiment, entry of overvoltage passing through the paths Y1 and Y2 described above into the main body portion 10 is suppressed since the creepage distance in the flow channel 12 is secured and the flow channel 12 and the buried member 13 are fixed to each other by the insulating adhesive 14. As a result, generation of an arcing phenomenon can be suppressed.

Note that in the above-described embodiment, an example in which the buried portion 131 has a protruded shape has been described. However, an outer peripheral surface may be an inclined surface inclined with respect to an exposed surface that is exposed, for example, from the main body portion 10. In a case where the outer peripheral surface has the inclined surface, a buried member (buried portion) has a conical shape. As the heat exchanging plate 1 according to the present embodiment, what has an outer shape such as a protruded shape or an inclined surface in which outer shape a diameter is decreased from a side exposed to the outside toward the opposite side can be applied. In addition, the buried portion 131 may have a cylindrical shape.

Moreover, in the above-described embodiment, a configuration in which a stepped portion is formed in the flow channel portion 121 to support the buried portion 131, or a configuration in which this stepped portion and the buried portion 131 do not come into contact with each other may be employed. It is preferable that the buried portion 131 is not in contact with the stepped portion of the flow channel portion 121 and a space (air layer) exists between this stepped portion and the buried portion 131 in a viewpoint of suppressing the entry of overvoltage.

Moreover, in the above-described embodiment, a configuration in which the buried member 13 has a columnar shape extending with a uniform diameter and a part of the buried member 13 (such as flow channel portion entry part illustrated in FIG. 2) does not enter the flow channel portion 121 may be employed.

First Modification Example

Figure 3:
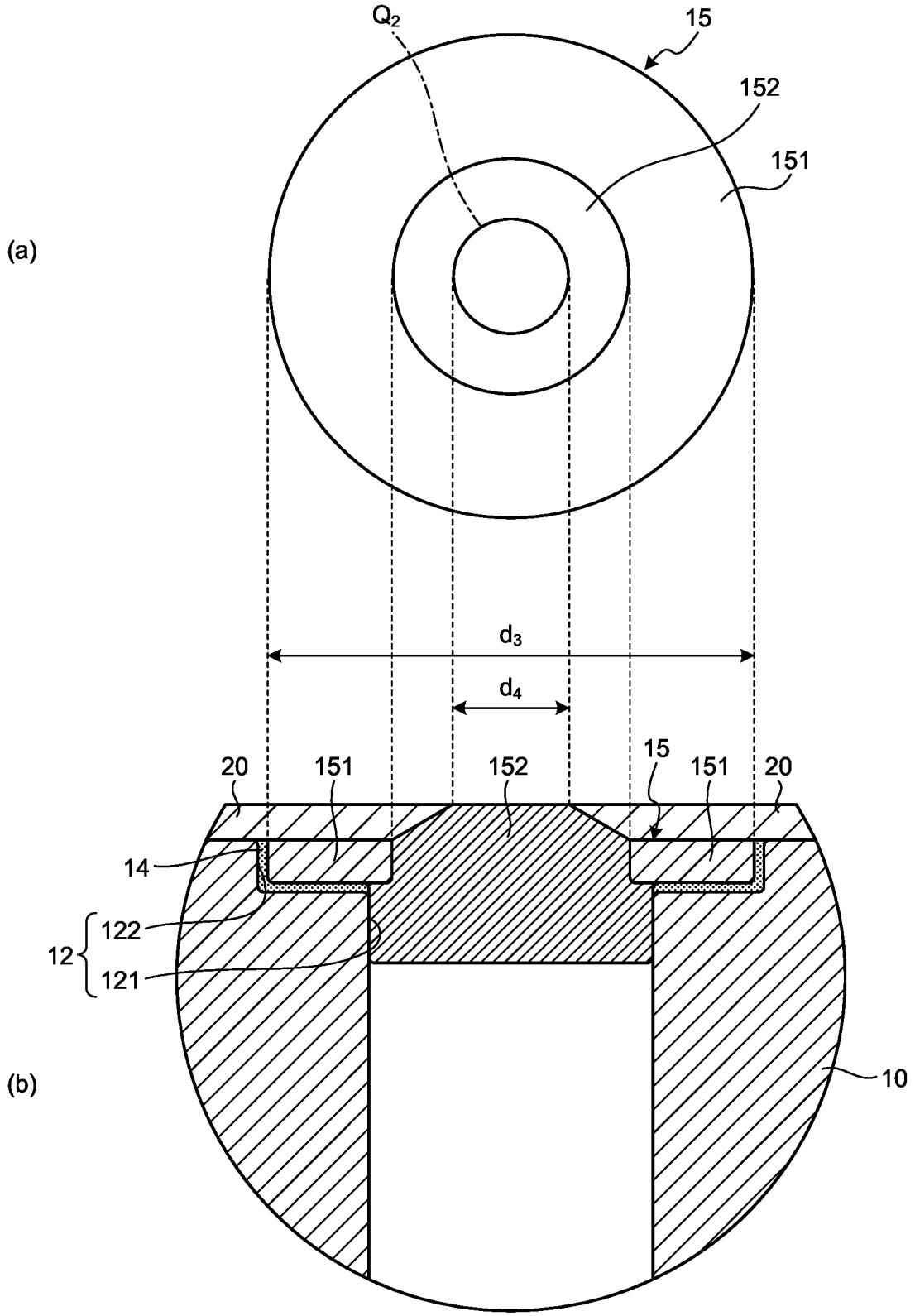
FIG. 3 is a schematic diagram for describing a configuration of a main part of a heat exchanging plate according to a first modification example of the embodiment of the present invention.

FIG. 3 is a schematic diagram for describing a configuration of a main part of a heat exchanging plate according to the first modification example of the embodiment of the present invention. (a) of FIG. 3 is a plan view illustrating a buried member 15 of the heat exchanging plate. (b) of FIG. 3 is a cross-sectional view in which a region corresponding to a region R illustrated in FIG. 1 is enlarged. The heat exchanging plate according to the first modification example includes a buried member 15 instead of the buried member 13 of the heat exchanging plate 1 described above. Since a configuration other than the buried member is the same as that of the heat exchanging plate 1 described above, a description thereof will be omitted.

The buried member 15 has a buried portion 151 buried in a flow channel 12, and a flow portion 152 held by the buried portion 151.

The buried portion 151 is made of a ceramic and is formed by utilization of a dense body having porosity equal to or lower than 20%. The buried portion 151 has a hollow disk shape and is housed in an opening portion 122.

The flow portion 152 is porous ceramics, and lets a medium such as gas flow from one side to the other side. A plurality of through holes that penetrates the one side and the other side and lets the medium flow is formed in the porous ceramics included in the flow portion 152.

An insulating adhesive 14 is provided between the buried portion 151 and the opening portion 122, and the two are fixed by the adhesive 14.

Here, when a diameter of an outer circumference (outside diameter) of the buried portion 151 is $d_3$ and a diameter of an outer circumference (outside diameter) of a part exposed from a cover 20 of the flow portion 152 is $d_4$, a ratio of the outside diameter $d_3$ to the outside diameter $d_4$ ($d_3/d_4$) is 1.2 or higher, and is preferably 1.5 or higher. Here, a circle formed by the outer circumference of the part exposed from the cover 20 of the flow portion 152 (circle $Q_2$ illustrated in FIG. 3) corresponds to the smallest circle among circles formed in the flow portion 152 and including all the through holes penetrating from the one side to the other side.

Moreover, since being a distance along an inner wall of the opening portion 122, a creepage distance of the buried member 15 in the flow channel 12 is a distance longer than a conventional one (see, for example, FIG. 8).

As described above, in the heat exchanging plate according to the present first modification example, entry of overvoltage passing through the path Y1 described above into a main body portion 10 is suppressed since the creepage distance in the flow channel 12 is secured and the flow channel 12 and the buried member 15 are fixed to each other by the insulating adhesive 14. As a result, generation of an arcing phenomenon can be suppressed. Moreover, since there is a space (air layer) between the buried portion 151 (flow portion 152) and the flow channel portion 121, it is possible to suppress entry of overvoltage passing through the path Y2 described above into the main body portion 10 as compared with a case where a buried portion 151 and a flow channel portion 121 are in contact with each other.

Note that in the above-described first modification example, an example in which the buried portion 151 has a hollow disk shape has been described. However, an outer peripheral surface may be an inclined surface inclined with respect to a surface on an annular side. In a case where the outer peripheral surface has the inclined surface, a buried member (buried portion) has a conical shape.

Second Modification Example

Figure 4:
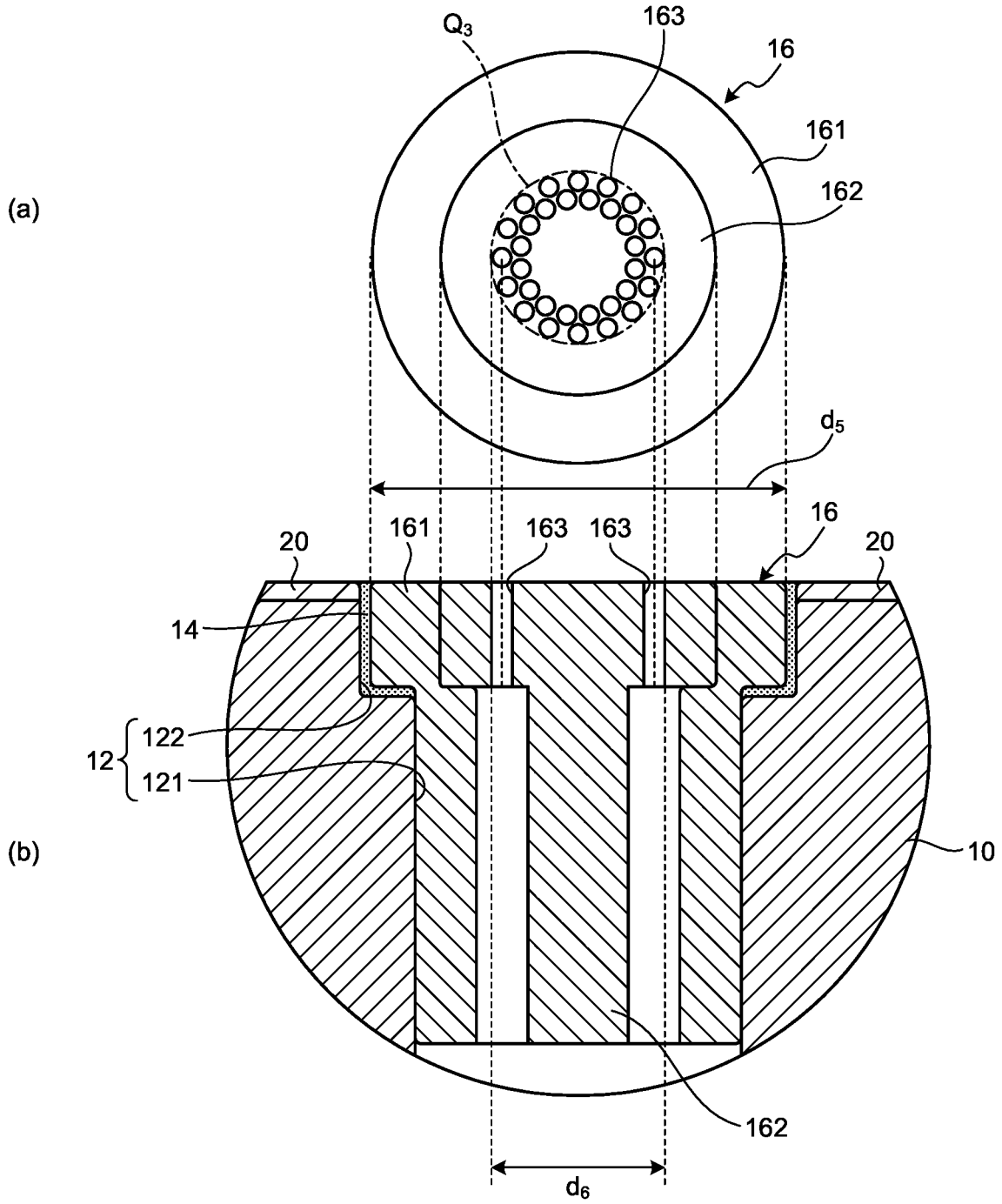
FIG. 4 is a schematic diagram for describing a configuration of a main part of a heat exchanging plate according to a second modification example of the embodiment of the present invention.

FIG. 4 is a schematic diagram for describing a configuration of a main part of a heat exchanging plate according to the second modification example of the embodiment of the present invention. (a) of FIG. 4 is a plan view illustrating a buried member 16 of the heat exchanging plate. (b) of FIG. 4 is a cross-sectional view in which a region corresponding to a region R illustrated in FIG. 1 is enlarged. The heat exchanging plate according to the second modification example includes a buried member 16 instead of the buried member 13 of the heat exchanging plate 1 described above. Since a configuration other than the buried member is the same as that of the heat exchanging plate 1 described above, a description thereof will be omitted.

The buried member 16 has a buried portion 161 buried in a flow channel 12, and a flow portion 162 that is held by the buried portion 161 and that lets inert gas flow.

The buried member 16 is made of a ceramic and is formed by utilization of a dense body having porosity equal to or lower than 20%. A plurality of through holes 163 that makes the outside and a flow channel portion 121 communicate with each other is formed in the flow portion 162. The plurality of through holes 163 is arrayed in an annular shape, for example.

The buried portion 161 has a hollow columnar shape extending in a stepped shape. The flow portion 162 has a base portion in which the through holes 163 are formed, and an extending portion extending from a central portion of the base portion in an extending direction of the buried portion 161. Note that the flow portion 162 may have no extending portion.

An insulating adhesive 14 is provided between the buried portion 161 and an opening portion 122, and the two are fixed by the adhesive 14. For example, the buried portion 161 and the flow portion 162 are manufactured separately, and are fixed by joining (bonding) of contact parts by integral sintering. Note that the buried portion 161 and the flow portion 162 may be fixed by a known fixing method.

Here, when a diameter of an outer circumference (outside diameter) of the buried portion 161 is $d_5$ and a diameter (outside diameter) of a circle circumscribed around the plurality of through holes 163 (formed region of the through holes 163) is $d_6$, a ratio of the outside diameter $d_5$ to the outside diameter $d_6$ ($d_6/d_6$) is 1.2 or higher, and is preferably 1.5 or higher. The "circle circumscribed around the plurality of through holes 163" as used herein refers to the smallest circle among circles including all the through holes 163.

Moreover, since being a distance along an inner wall of the opening portion 122, a creepage distance of the buried member 16 in the flow channel 12 is a distance longer than a conventional one (see, for example, FIG. 8).

As described above, in the heat exchanging plate according to the present second modification example, entry of overvoltage passing through the path Y1 described above into a main body portion 10 is suppressed since the creepage distance in the flow channel 12 is secured and the flow channel 12 and the buried member 16 are fixed to each other by the insulating adhesive 14. As a result, generation of an arcing phenomenon can be suppressed. Moreover, since the buried portion 161 exists between the flow portion 162 and the flow channel portion 121, it is possible to suppress entry of overvoltage passing through the path Y2 described above into the main body portion 10 as compared with a case where the flow portion 162 and the flow channel portion 121 are in contact with each other.

Third Modification Example

Figure 5:
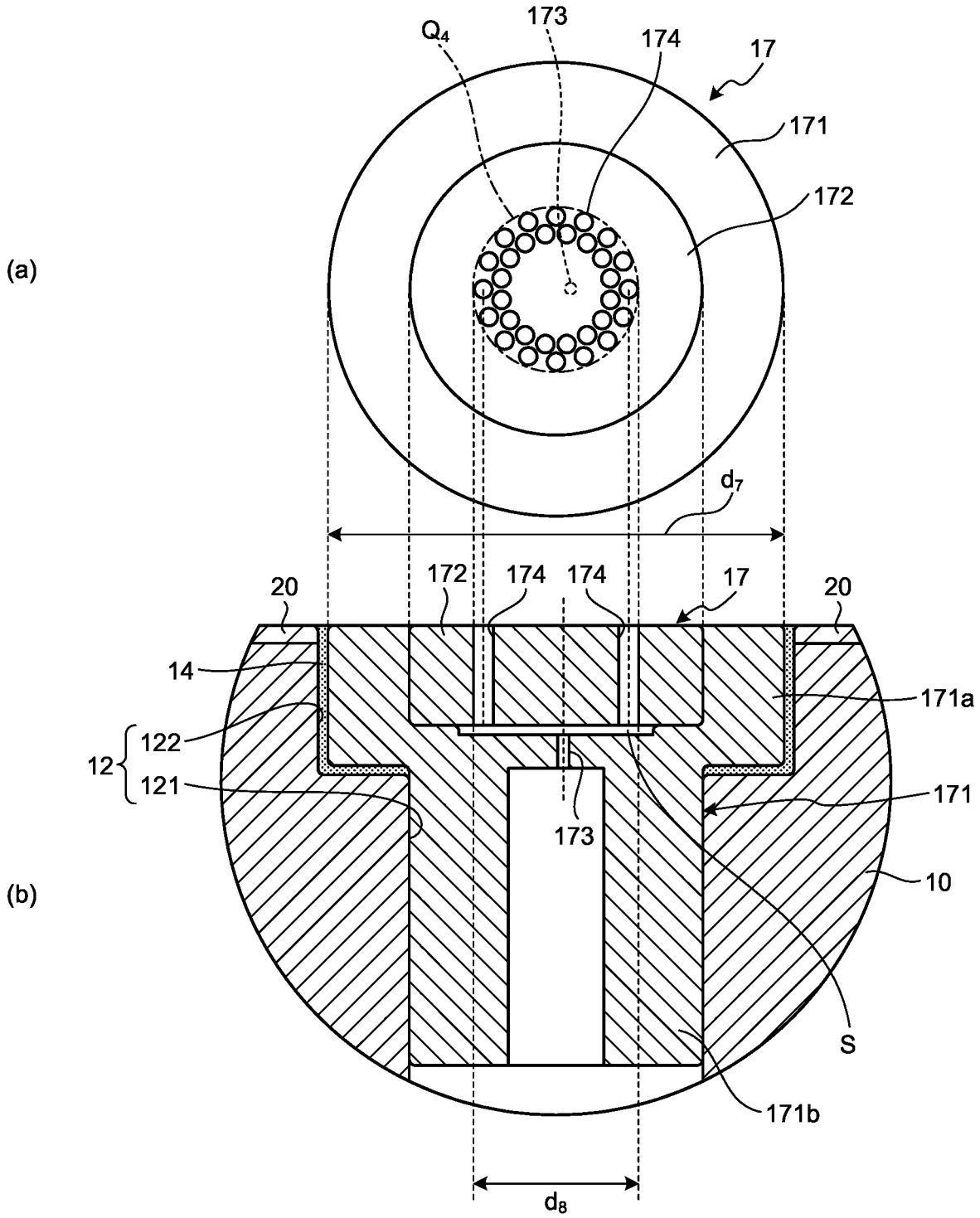
FIG. 5 is a schematic diagram for describing a configuration of a main part of a heat exchanging plate according to a third modification example of the embodiment of the present invention.

FIG. 5 is a schematic diagram for describing a configuration of a main part of a heat exchanging plate according to the third modification example of the embodiment of the present invention. (a) of FIG. 5 is a plan view illustrating a buried member 17 of the heat exchanging plate. (b) of FIG. 5 is a cross-sectional view in which a region corresponding to a region R illustrated in FIG. 1 is enlarged. The heat exchanging plate according to the third modification example includes a buried member 17 instead of the buried member 13 of the heat exchanging plate 1 described above. Since a configuration other than the buried member is the same as that of the heat exchanging plate 1 described above, a description thereof will be omitted.

The buried member 17 has a buried portion 171 buried in a flow channel 12, and a flow portion 172 that is held by the buried portion 171 and that lets inert gas flow.

The buried member 17 is made of a ceramic and is formed by utilization of a dense body having porosity equal to or lower than 20%. A through hole 173 (second through hole) that makes one end side and the other end side communicate with each other is formed in the buried portion 171. A plurality of through holes 174 that makes the outside and a flow channel portion 121 communicate with each other is formed in the flow portion 172. The plurality of through holes 174 is arrayed in an annular shape, for example. The flow portion 172 makes the outside and the flow channel portion 121 communicate with each other through the through hole 173.

The buried portion 171 has a hollow columnar shape extending in a stepped shape. The buried portion 171 has a hole to hold the flow portion 172, a base portion 171*a* in which the through hole 173 is formed, and an extending portion 171*b* extending in a tubular shape from a central portion of the base portion 171*a* in an extending direction of the buried portion 171. Note that the buried portion 171 may have no extending portion 171*b*.

An insulating adhesive 14 is provided between the buried portion 171 and an opening portion 122, and the two are fixed by the adhesive 14. For example, the buried portion 171 and the flow portion 172 are manufactured separately, and are fixed by joining (bonding) of contact parts by integral sintering. Note that the buried portion 171 and the flow portion 172 may be fixed by a known fixing method.

Moreover, a formed position of the through hole 173 and a formed position of each of the through holes 174 are deviated from each other. That is, the through hole 173 and the through holes 174 are formed in positions where central axes of the holes (central axes in a penetrating direction) are not coincident with each other. Furthermore, the through hole 173 and the through holes 174 are formed in positions where opening regions do not overlap with each other when viewed in a central axis direction.

Here, when a diameter of an outer circumference (outside diameter) of the buried portion 171 is $d_7$ and a diameter (outside diameter) of a circle circumscribed around the plurality of through holes 174 (formed region of the through holes 174) is $d_8$, a ratio of the outside diameter $d_7$ to the outside diameter $d_8$ ($d_7/d_8$) is 1.2 or higher, and is preferably 1.5 or higher. The "circle circumscribed around the plurality of through holes 174" as used herein refers to the smallest circle among circles including all the through holes 174.

Moreover, since being a distance along an inner wall of the opening portion 122, a creepage distance of the buried member 17 in the flow channel 12 is a distance longer than a conventional one (see, for example, FIG. 8).

As described above, in the heat exchanging plate according to the present third modification example, entry of overvoltage passing through the path Y1 described above into a main body portion 10 is suppressed since the creepage distance in the flow channel 12 is secured and the flow channel 12 and the buried member 17 are fixed to each other by the insulating adhesive 14. As a result, generation of an arcing phenomenon can be suppressed. Moreover, since the buried portion 171 exists between the flow portion 172 and the flow channel portion 121, it is possible to suppress entry of overvoltage passing through the path Y2 described above into the main body portion 10 as compared with a case where the flow portion 172 and the flow channel portion 121 are in contact with each other.

Fourth Modification Example

Figure 6:
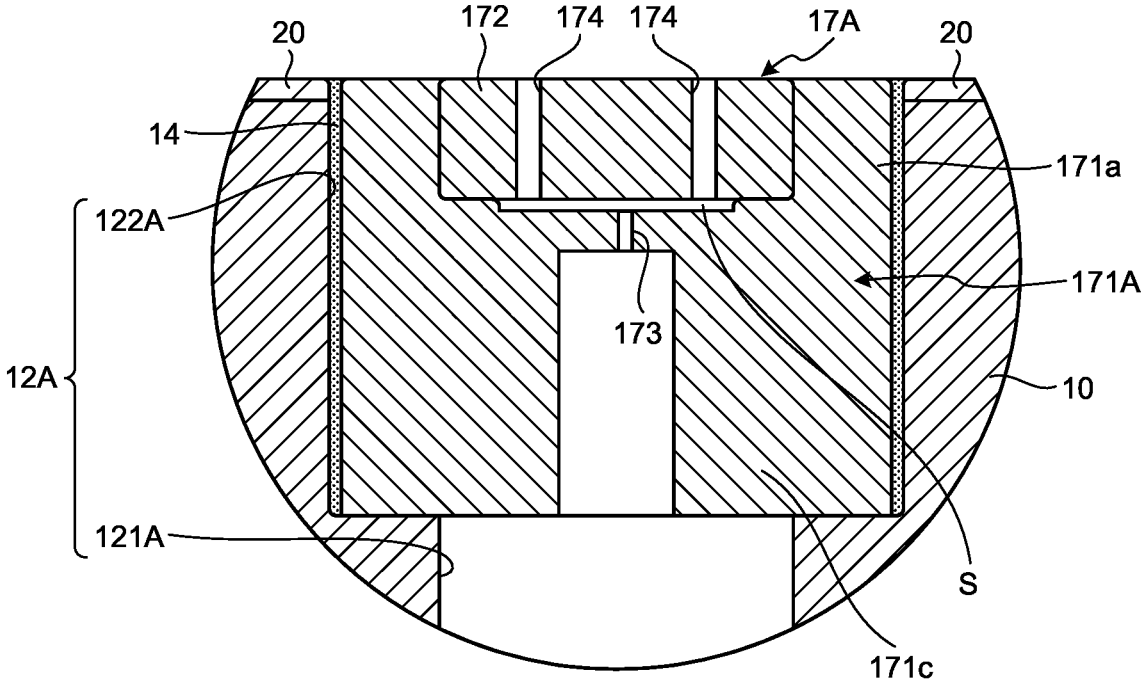
FIG. 6 is a schematic diagram for describing a configuration of a main part of a heat exchanging plate according to a fourth modification example of the embodiment of the present invention.

FIG. 6 is a schematic diagram for describing a configuration of a main part of a heat exchanging plate according to the fourth modification example of the embodiment of the present invention. FIG. 6 is a cross-sectional view in which a region corresponding to a region R illustrated in FIG. 1 is enlarged. The heat exchanging plate according to the fourth modification example includes a buried member 17A instead of the buried member 13 of the heat exchanging plate 1 described above. Moreover, in the fourth modification example, a flow channel 12A is formed instead of the above-described flow channel 12. Since a configuration other than the buried member and the flow channel is the same as that of the heat exchanging plate 1 described above, a description thereof will be omitted.

The flow channel 12A has a flow channel portion 121A one end of which is connected to an inert gas introduction port and which forms a flow channel in a main body portion 10, and an opening portion 122A provided at the other end of the flow channel portion 121A. A diameter of the opening portion 122A is larger than a diameter of the other end of the flow channel portion 121A. Thus, the flow channel 12A has a stepped hole shape in the vicinity of the opening.

A buried member 17A buried in the opening of the flow channel 12A is provided in the flow channel 12A.

The buried member 17A is made of a ceramic and is formed by utilization of a dense body having porosity equal to or lower than 20%. The buried member 17A has a buried portion 171A buried in the flow channel 12A, and a flow portion 172 that is held by the buried portion 171A and that lets inert gas flow. Since the flow portion 172 is the same as that of the third modification example described above, a description thereof will be omitted.

A through hole 173 (second through hole) that makes one end side and the other end side communicate with each other is formed in the buried portion 171A.

The buried portion 171A has a hollow columnar shape. The buried portion 171A has a hole to hold the flow portion 172, a base portion 171*a* in which the through hole 173 is formed, and an extending portion 171*c* extending in a tubular shape from a central portion of the base portion 171*a* in an extending direction of the buried portion 171A. Note that the buried portion 171A may have no extending portion 171*c*.

The buried portion 171A is placed in a stepped portion formed by the flow channel portion 121A and the opening portion 122A, and is housed in the opening portion 122A.

An insulating adhesive 14 is provided between the buried portion 171A and an opening portion 122A, and the two are fixed by the adhesive 14. For example, the buried portion 171A and the flow portion 172 are manufactured separately, and are fixed by joining (bonding) of contact parts by integral sintering. Note that the buried portion 171A and the flow portion 172 may be fixed by a known fixing method.

Moreover, similarly to the third modification example, a formed position of the through hole 173 and a formed position of each through hole 174 are deviated from each other.

Here, a ratio of a diameter of an outer circumference (outside diameter) of the buried portion 171A to a diameter (outside diameter) of a circle circumscribed around the plurality of through holes 174 (formed region of the through holes 174) (corresponding to $d_7/d_8$ described above) is 1.2 or higher, and is preferably 1.5 or higher.

Moreover, since being a distance along an inner wall of the opening portion 122A, a creepage distance of the buried member 17A in the flow channel 12A is a distance longer than a conventional one (see, for example, FIG. 8).

As described above, in the heat exchanging plate according to the present fourth modification example, entry of overvoltage passing through the path Y1 described above into a main body portion 10 is suppressed since the creepage distance in the flow channel 12A is secured and the flow channel 12A and the buried member 17A are fixed to each other by the insulating adhesive 14. As a result, generation of an arcing phenomenon can be suppressed. Moreover, since the buried portion 171A exists between the flow portion 172 and a flow channel portion 121A, it is possible to suppress entry of overvoltage passing through the path Y2 described above into the main body portion 10 as compared with a case where the flow portion 172 and the flow channel portion 121A are in contact with each other.

Moreover, since the buried portion 171A of the buried member 17A has a columnar shape, a manufacturing cost of the heat exchanging plate according to the present fourth modification example can be reduced compared to that of a configuration having a stepped shape (such as the third modification example (see FIG. 5)).

Fifth Modification Example

Figure 7:
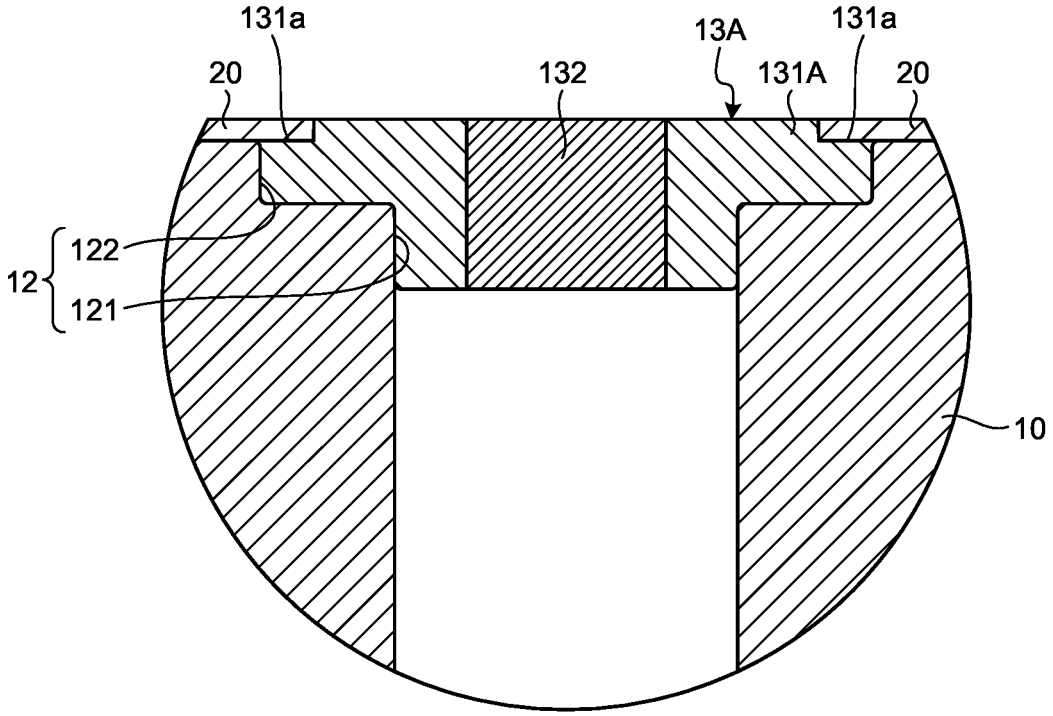
FIG. 7 is a schematic diagram for describing a configuration of a main part of a heat exchanging plate according to a fifth modification example of the embodiment of the present invention.

FIG. 7 is a cross-sectional view for describing a configuration of a main part of a heat exchanging plate according to the fifth modification example of the embodiment of the present invention. FIG. 7 is a view corresponding to a cross-sectional view in which a region corresponding to a region R illustrated in FIG. 1 is enlarged. The heat exchanging plate according to the fifth modification example includes a buried member 13A instead of the buried member 13 of the heat exchanging plate 1 described above. Since a configuration other than the buried member is the same as that of the heat exchanging plate 1 described above, a description thereof will be omitted.

The buried member 13A has a buried portion 131A buried in a flow channel 12, and a flow portion 132 held by the buried portion 131A. Since a configuration of the flow portion 132 is the same as that of the above-described embodiment, a description thereof will be omitted.

The buried portion 131A is made of a ceramic and is formed by utilization of a dense body having porosity equal to or lower than 20%. The buried portion 131A has a hollow disk shape and is housed in an opening portion 122. A notch portion 131*a* corresponding to a thickness of a cover 20 is formed along an outer edge of the buried portion 131A in a surface on a side exposed from a main body portion 10 among surfaces of the buried portion 131A.

In the buried portion 131A, the notch portion 131*a* is covered with the cover 20. The buried portion 131A is fixed to the main body portion 10 by the cover 20.

Here, a ratio of a diameter of an outer circumference (outside diameter) of the buried portion 131A to a diameter of an outer circumference (outside diameter) of a part of the flow portion 132 which part is exposed from the cover 20 is 1.2 or higher, and is preferably 1.5 or higher.

As described above, in the heat exchanging plate according to the present fifth modification example, a creepage distance in the flow channel 12 is secured, and the flow channel 12 and the buried member 13A are fixed not by an adhesive 14 but by the cover 20 that is a sprayed film. An effect similar to that of the embodiment can be also acquired in the present fifth modification example.

Note that in the above-described fifth modification example, an example in which the notch portion 131*a* is provided in the buried portion 131A and the notch portion 131*a* is covered with the cover 20 has been described. However, a configuration in which a part of a buried portion 131 that does not include a notch portion 131*a* is covered with a cover 20 and which is, for example, in the embodiment may be employed.

Moreover, in the above-described embodiment and modification examples, examples of cooling a target member have been described. However, a heat exchanging plate may promote a heat exchange to warm a target member. In a case where the heat exchanging plate warms the target member, a medium such as warm water flows through a flow channel 11 and gas such as warm air which gas gives heat flows through a flow channel 12 in the heat exchanging plate.

Moreover, in the above-described embodiment and modification examples, examples of a heat exchanging plate that discharges inert gas to cool a target member have been described. However, inert gas for a pressure adjustment which gas is used to separate an adsorbed member may be discharged. In such a manner, the present invention can be used as a plate with a flow channel which plate discharges inert gas corresponding to a purpose.

In such a manner, the present invention may include various embodiments not described herein, and various design changes and the like can be made within the scope of a technical idea specified by the claims.

INDUSTRIAL APPLICABILITY

As described above, a plate with a flow channel according to the present invention is suitable for suppressing generation of an arcing phenomenon.

REFERENCE SIGNS LIST

1 HEAT EXCHANGING PLATE
10 MAIN BODY PORTION

11, 12 FLOW CHANNEL
13, 13A, 15 to 17, 17A BURIED MEMBER
14 ADHESIVE
20 COVER
131, 131A, 151, 161, 171, 171A BURIED PORTION
132, 152, 162, 172 FLOW PORTION
163, 174 THROUGH HOLE

The invention claimed is:

1. A plate comprising:

a main body;

a flow channel provided in the main body and configured to flow inert gas therein;

a cover configured to cover a surface of the main body where the flow channel is formed;

a buried member buried in an opening of the flow channel, the buried member including a buried portion fixed to the flow channel and made of dense ceramic having a porosity equal or lower than 20%, and a flow portion held by the buried portion and configured to let the inert gas flow from an inside to an outside of the main body, the flow portion being made of porous ceramic; and an insulating adhesive configured to fix the buried member to the main body, wherein a ratio of a diameter of an outer circumference of the buried portion to a diameter of a circular region enclosing all of the through holes is 1.2 or higher, the pores of the porous ceramic are configured to allow the inert gas flow from the inside to the outside of the main body, and the flow portion has an exposed surface on an outside surface of the main body.

2. The plate according to claim 1, wherein the buried portion has a shape in which a diameter of an outer shape is decreased from a side exposed to the outside toward an opposite side.

3. The plate according to claim 2, wherein the opening of the flow channel has a stepped hole shape, and the outer shape of the buried portion has a protruded shape corresponding to the shape of the opening.

4. The plate according to claim 1, wherein the buried member has an insulating property.

5. The plate according to claim 1, wherein the buried portion includes a second through hole configured to make the flow portion and the flow channel communicate with each other, and a formed region of the second through hole and a formed region of the plurality of through holes in the flow portion are arranged at different positions when viewed in a penetrating direction.

6. The plate according to claim 1, wherein the cover is configured to cover a part of the buried portion.

7. The plate according to claim 1, wherein the ratio of the diameter of the outer circumference of the buried portion to the diameter of the circular region enclosing all of the through holes is 1.5 or higher.

* * * * *